United States Patent [19]

Swietlik

[11] Patent Number: 4,786,082

[45] Date of Patent: Nov. 22, 1988

[54] SKIER'S SEAT

[76] Inventor: Daniel A. Swietlik, 3109 Goodview Trail, Hollywood, Calif. 90068

[21] Appl. No.: 120,323

[22] Filed: Nov. 13, 1987

[51] Int. Cl.[4] ..... A63C 11/00

[52] U.S. Cl. ..... 280/812; 297/129; 135/66

[58] Field of Search ..... 280/812, 816; 135/65, 135/66; 297/129; 294/141, 142, , 147

[56] References Cited

U.S. PATENT DOCUMENTS

| | | | |
|---|---|---|---|
| 763,166 | 6/1904 | Dougherty | 248/155.3 |
| 779,449 | 1/1905 | Cane | 248/155.3 |
| 1,089,295 | 3/1914 | Vallier | 248/155.1 |
| 1,697,552 | 1/1929 | Brooks | 248/155.1 |
| 2,257,831 | 10/1941 | Wood | 280/812 |
| 2,445,344 | 7/1948 | Wachtel | 280/812 |
| 2,709,603 | 5/1955 | Osmun | 280/812 |
| 3,179,436 | 4/1965 | Choy | 280/812 |
| 3,874,687 | 4/1975 | Cadwalader | 280/812 |
| 3,902,731 | 9/1975 | Fagen et al. | 280/812 |
| 4,065,140 | 12/1977 | Cadwalader | 280/812 |
| 4,121,605 | 10/1978 | Schmerl | 135/66 |
| 4,456,284 | 6/1984 | Saka | 280/812 |
| 4,593,933 | 6/1986 | Nunno | 280/812 |

*Primary Examiner*—David M. Mitchell
*Assistant Examiner*—Richard Camby
*Attorney, Agent, or Firm*—Kelly, Bauersfeld & Lowry

[57] ABSTRACT

A portable and collapsible skier's seat includes a male seat component and a female seat component, each pivotably mounted to a respective standard ski pole by a supporting sleeve. The seat is formed by extending each seat component to a perpendicular orientation with respect to the associated pole, and then inserting the male seat component into a receiving channel of the female seat component to form a rigid bar-like seat extending between generally parallel ski poles. To disassemble the seat and immediately resume skiing, the ski poles are simply pulled apart to separate the seat components, and then each component is tapped downwardly toward its attached pole. A spring pulls the seat component downwardly into engagement with a locking mechanism for holding the seat component in a parallel orientation with respect to the pole.

21 Claims, 2 Drawing Sheets

FIG. 4
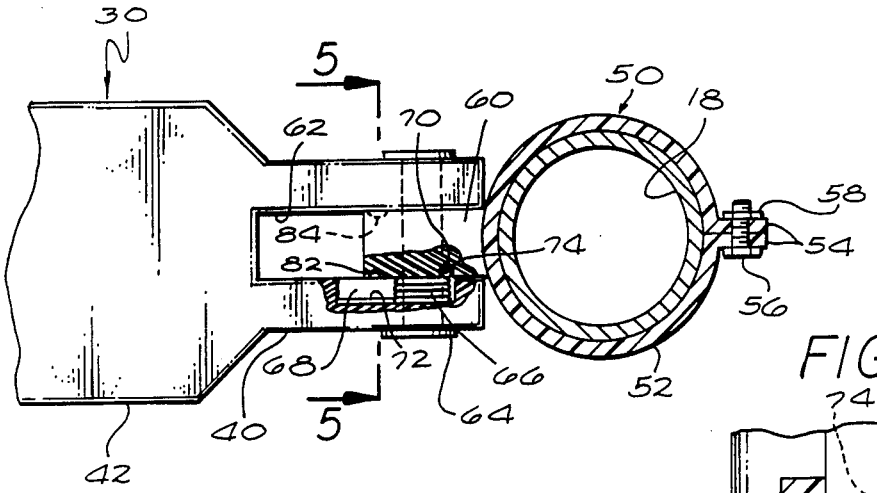
FIG. 5
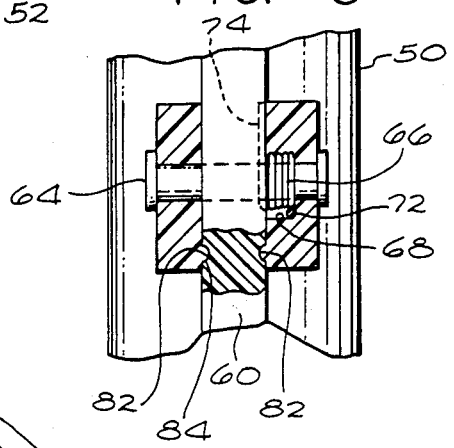
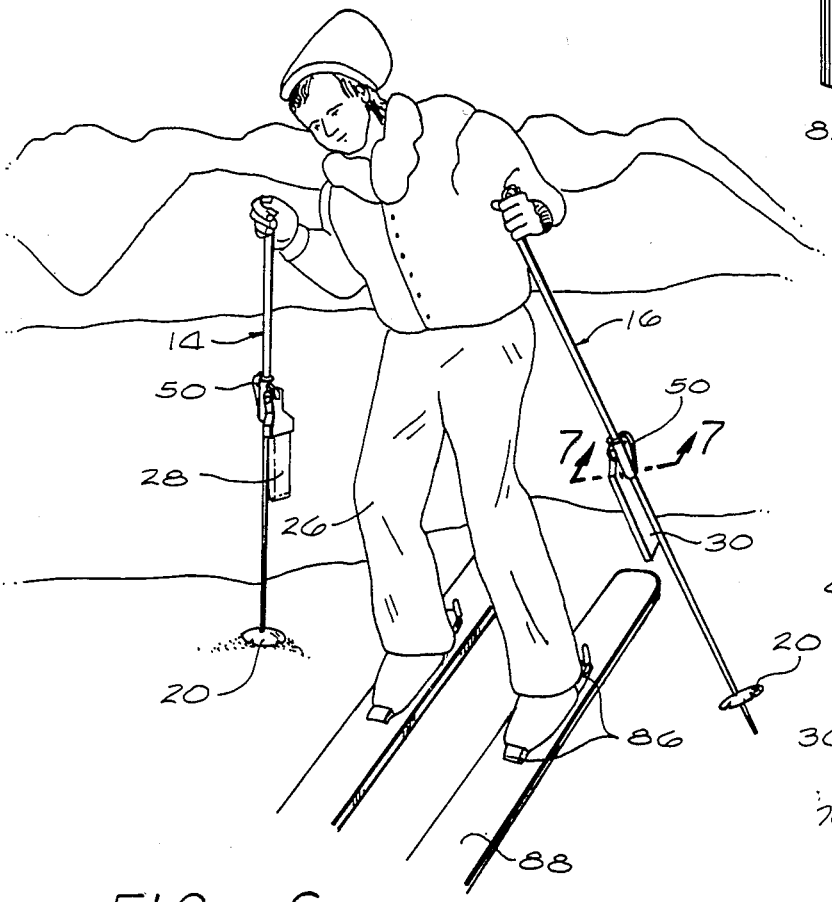
FIG. 6
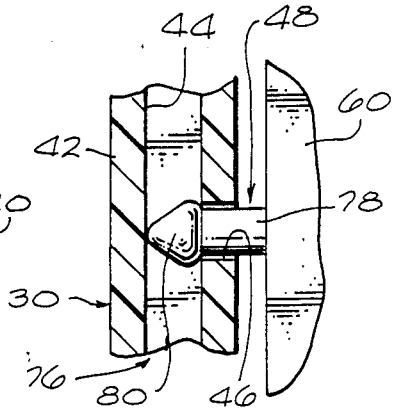
FIG. 7

SKIER'S SEAT

BACKGROUND OF THE INVENTION

This invention relates generally to snow skiing accessories, and more specifically to a compact and portable apparatus which, in connection with a pair of ski poles, can be configured to provide a seat for a skier.

In the course of normal recreational skiing, a skier may spend hours on his feet, whether it be while skiing, waiting in a lift line or simply resting. Many skiers have found it nearly impossible to assume a comfortable rest position, even where conventional seating facilities are available, while wearing snow skis. Thus, some have sought to provide a portable seating arrangement which can be carried by the skier and used when needed, even when wearing skis.

In prior attempts to design an acceptable skiers' seat, many have sought to use flexible cords or bands which can be attached to the ski poles to form back and seat supports. Several drawbacks have been noted in connection with the use of such flexible cords or bands, however, including the inability to instantly form the skiers' seat with the ski poles, a similar inability to instantly break-down the flexible skiers' seat and resume normal use of the poles, the inconvenience of having to carry flexible bands separately from the poles while skiing, and the fact that the provision of a flexible seat between two generally vertical poles applies forces to the poles tending to damage them.

Other skiers, seat designs have been offered which provide a rigid seating surface, including the attachment of a bar between ski poles, see Wachtel, U.S. Pat. No. 2,445,344, and the provision of various seating surfaces on a single pole. Like those seats formed of flexible cords or bands, however, the prior skiers' seats which provide a solid seating surface require more assembly and disassembly than is desirable, and are sometimes of such construction as to make economical production impractical.

Accordingly, there has been a need for a novel skiers' seat apparatus which is lightweight, durable and capable of being conveniently carried on standard ski poles without any appreciable degradation in the ability of the skier to use the poles. Additionally, a need exists for a skiers' seat assembly which is of economical construction and which can be configured to provide a strong and reliable seat quickly and with a minimum of effort. Such a skiers' seat assembly must similarly be capable of instant disassembly to facilitate use in lift lines or other similar situations. Further, a skiers' seat assembly is needed which can be placed on standard ski poles now in use, without requiring modifications to the standard poles. The present invention fulfills these needs and provides other related advantages.

SUMMARY OF THE INVENTION

The present invention resides in an improved skiers' seat which is quickly and efficiently assembled on demand by the skier, to provide a convenient resting place for the skier while wearing skis or in an area where conventional seating is unavailable. The skiers' seat comprises, generally, a seat assembly having separable components which are each fixed to respective ski poles. These separable components have portions which are movable between a first position which permits normal use of the ski poles while skiing, and a second position which, in connection with the poles, forms a stable seat for the skier.

In a preferred form of the invention, a first sleeve is positionable on a first ski pole, and a male seat component, including a first bracket, is attached to the first sleeve and is pivotable with respect thereto. A support bar extends rigidly outwardly from the first bracket, and the first bracket and the support bar are pivotable between a first position wherein the male seat component lies substantially parallel to the first pole to permit normal use of the first pole while skiing, and a second position wherein the male seat component extends substantially perpendicularly away from the first pole.

A second sleeve is positionable on a second ski pole, and a female seat component, including a second bracket, is attached to the second sleeve and is pivotable with respect thereto. The female seat component includes a receiving means which extends rigidly outwardly from the second bracket. The second bracket and the receiving means are pivotable between a first position wherein the female seat component lies substantially parallel to the second pole to permit normal use of the second pole while skiing, and a second position wherein the female seat component extends substantially perpendicularly away from the second pole. The skiers' seat is formed by simply extending the support bar and the receiving means into their second positions, and inserting the support bar into the receiving means to form a rigid seat extending between the first and second poles.

Means are provided for holding the male seat component and the female seat component in their respective second positions prior to engagement of the receiving means and the support bar. The holding means comprises cavity means associated with the first and second sleeves, and knob means associated with the first and second brackets. The knob means engage the cavity means as the brackets are pivoted to their respective second positions, to temporarily hold the male and female seat components in their respective second positions.

Further, means are provided for biasing the male and female seat components toward their respective first positions, and locking them in such first positions to facilitate use of the ski poles when the skiers' seat is not assembled. The biasing means includes a spring operatively connected between both sets of sleeves and brackets. This spring applies a constant downward force to the respective seat components. The locking means includes a seat retainer stud associated with each of the first and second sleeves, and a stud locking aperture associated with each of the male and female seat components.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 4 is an enlarged, partially sectional and partially fragmented plan view taken generally along the line 4—4 of FIG. 3, illustrating, in detail, means for holding the seat components in a second or extended position, and biasing means tending to urge the seat components downwardly to lie adjacent the ski poles;

FIG. 5 is an elevational, partially sectional and partially fragmented view taken generally along the line 5—5 of FIG. 4, further illustrating the means for holding the seat components in their second positions, and the biasing means tending to urge the seat components downwardly;

FIG. 6 is perspective view of the snow ski pole assembly of FIG. 1, illustrating the male and female seat components pivoted downwardly into a first position which permits normal use of the ski poles while skiing; and FIG. 7 is an enlarged, partially sectional, elevational view taken generally along the line 7—7 of FIG. 6, illustrating the manner in which a seat retainer stud engages a stud locking aperture to hold a seat component securely in its first position.

DETAILED DESCRIPTION OF THE PREFERRED EMBODIMENT

Figure 1:
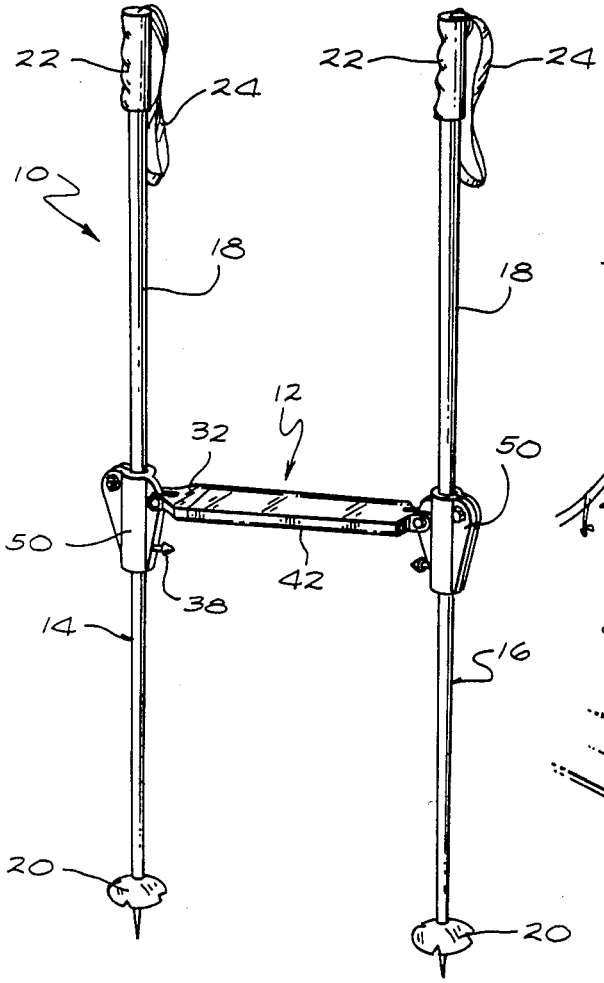
FIG. 1 is a perspective view of a snow ski pole assembly embodying the invention, illustrating the manner in which a skiers' seat apparatus is carried on a pair of standard ski poles.
Figure 2:
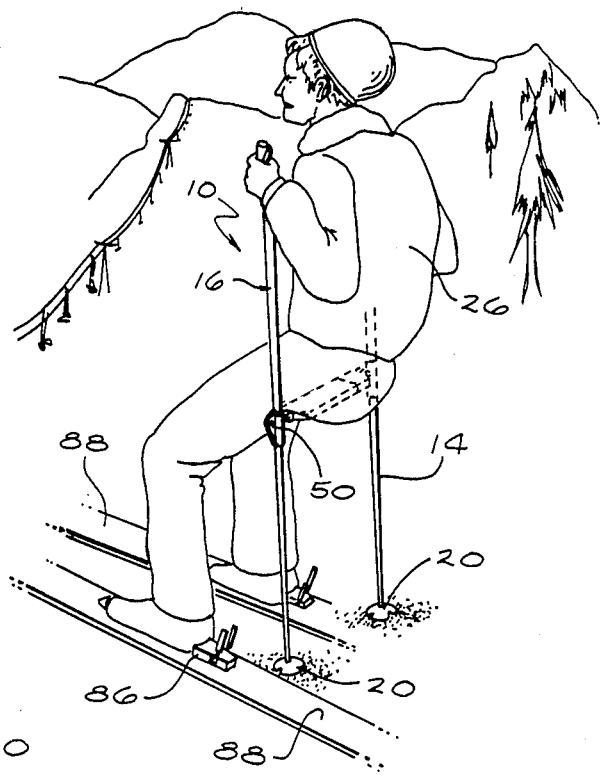
FIG. 2 is another perspective view of the ski pole assembly illustrated in FIG. 1, showing the manner in which a skier can conveniently utilize the skiers' seat of the present invention for resting while wearing skis.

As shown the drawings for purposes of illustration, the present invention is concerned with an improved ski pole assembly, generally designated in the accompanying drawings by the reference number 10. This improved ski pole assembly 10 comprises, generally, a skiers' seat 12 attached to a pair of ski poles 14 and 16, wherein each ski pole includes a shaft portion 18, a snow pad 20, a handle 22 and a wrist strap 24. The skiers' seat 12 can be assembled quickly and easily to provide a convenient seat for a skier 26 on the mountain slopes or while waiting in a lift line (FIGS. 1 and 2). The skiers' seat 12 can also be quickly and easily disassembled, and components stored in a position which allows normal use of the poles 14 and 16 while skiing (FIG. 6).

In accordance with the present invention, and as illustrated best in FIGS. 1, 3 through 5 and 7, the skiers' seat 12 includes a male seat component 28 attached to the first ski pole 14, and a female seat component 30 attached to the second ski pole 16. The attachment of the male seat component 28 and the female seat component 30 to the respective ski poles 14 and 16 permit each seat component to be independently pivoted between a first position wherein the seat components lie substantially parallel to the longitudinal axis of the respective ski pole shaft 18 to permit normal use of the poles during skiing, and a second position wherein the seat components extend substantially perpendicularly away from the respective ski pole.

The male seat component 28 includes a bracket member 32 and an elongated rigid support bar 34 which extends outwardly from the bracket member 32 and has a generally rectangular cross section. The support bar 34 further includes a stud locking aperture 36 positioned to receive a male seat component retainer stud 38 when the male seat component 28 is pivoted downwardly into its first position.

The female seat component 30 includes a bracket member 40 similar to the bracket member 32, and an elongated rigid sheath 42 which extends outwardly from the bracket member 40. This sheath 42 forms a generally rectangular receiving channel 44 which is dimensioned to receive the support bar 34 therein. The sheath 42 further includes a female seat component stud locking aperture 46 positioned to receive a female seat component retainer stud 48 when the female seat component 30 is pivoted downwardly into its first position.

To facilitate pivotal attachment of the seat components 28 and 30 to the ski poles 14 and 16, sleeves 50 are mounted on each ski pole shaft 18 at a desirable height for forming the skiers' seat 12. Each sleeve 50 includes an elongated collar 52 which substantially surrounds a portion of the respective ski pole shaft 18. The collar 52 is elongated to provide reinforcement for the shafts 18 at the primary areas where forces will be transferred from a resting skier to the ski poles 14 and 16. Sleeve clamp flanges 54 extend outwardly from adjacent edges of the collar 52 and lie generally parallel to one another. A sleeve clamp bolt 56 extends through the adjacent clamp flanges 54, and a nut 58 is provided for tightening these clamp flanges in order to secure the collars 52 at a desired location on the shafts 18.

Extending outwardly from the collar 52 and opposite the clamp flanges 54 is a seat support flange 60. This sat support flange 60 is received within a clevis channel 62 formed by each of the bracket members 32 and 40. A pivot pin 64 extends through the bracket members 32 and 40 and the respective seat support flange 60 to connect the seat components 28 and 30 to their respective sleeves 50.

In order to bias the seat components 28 and 30 downwardly to lie in a parallel orientation with respect to the adjacent ski pole shafts 18, a spring 66 is operatively connected between both sets of sleeves 50 and bracket members 32 and 40. As illustrated best in FIGS. 4 and 5, each of the bracket members 32 and 40 include a seat spring retaining channel 68, and each of the seat support flanges 60 include a similar support flange spring retaining channel 70. When the spring 66 is positioned over the pivot pin 64, a first end 72 of the spring is positioned within the seat spring retaining channel 68, and a second end 74 of the spring is positioned within the support flange spring retaining channel 70. The spring 66 is properly tensioned to apply a biasing force to the respective seat component 28 or 30 to urge it downwardly toward its first position. This is desirable in order to help prevent the seat components 28 and 30 from moving away from the respective ski poles 14 and 16 when they are in normal use during skiing as illustrated in FIG. 6.

In order to further prevent unintended movement of the seat components 28 and 30 away from the respective ski poles 14 and 16, a locking mechanism 76 is provided. As illustrated best in FIGS. 3 and 7, the locking mechanism 76 comprises, essentially, the seat retainer studs 38 and 48 mentioned previously, and the stud locking apertures 36 and 46. Each of these seat retainer studs 38 and 48 include a shaft portion 78 which extends outwardly from the seat support flange 60 beneath the respective seat component 28 or 30, and a resilient head 80 dimensioned to be inserted through the respective stud locking aperture 36 and 46 for purposes of holing the seat components securely in their first positions. As illustrated in FIG. 7, the resilient head 80 for the female seat component retainer stud 48 must be dimensioned to be able to fit within the receiving channel 44. No such restriction need be placed on the resilient head 80 of the male seat component retainer stud 38 since it will extend beyond the upper surface of the support bar 34 after it has been inserted through the male seat component stud locking aperture 36. It is preferred, however, that this resilient head 80 be as small as possible in order to reduce the weight of the skiers' seat 12 and minimize any portion of the apparatus extending toward the skier 26 when the ski poles 14 and 16 are utilized in a normal manner.

Although means for biasing the seat components 28 and 30, and for locking them in their respective first positions have been deemed desirable for ensuring that the skiers' seat 12 will not interfere with the normal use of the ski poles 14 and 16 while skiing, this same structure may tend to make assembly of the skiers' seat 12 less convenient than desired without the provision of some means for temporarily holding the seat components 28 and 30 in their respective second positions. Toward this end, each of the seat support flanges 60 is constructed to include a flange cavity 82, and each of the bracket members 32 and 40 are constructed to include a semispherical knob 84 which can interact with the cavities 82. When the seat components 28 and 30 are lifted into their respective second positions, the semispherical knobs 84 will engage the flange cavities 82 with just enough retaining capability to hold the respective seat component 28 or 30 in its second position so that the skiers' seat 12 may be conveniently assembled. It is preferred that the holding force of the cavities 82 and the knobs 84 be overcome when the seat components are tapped downwardly by the skier. This feature will help facilitate the quick disassembly of the skiers' seat when desired.

As illustrated best in FIG. 6, the ski poles 14 and 16 can be used in a normal manner when the seat components 28 and 30 are pivoted downwardly into their respective first positions. The biasing force of the spring 66 and the locking mechanism 76 ensure that the seat components 28 and 30 remain positioned as shown. Further, the seat components are preferably made of lightweight, high density plastic which minimizes the additional weight of the skiers' seat 12 on the poles 14 and 16. The density of the plastic in each of the seat components 28 and 30 can be adjusted to create a balanced distribution of weight on the poles 14 and 16.

Figure 3:
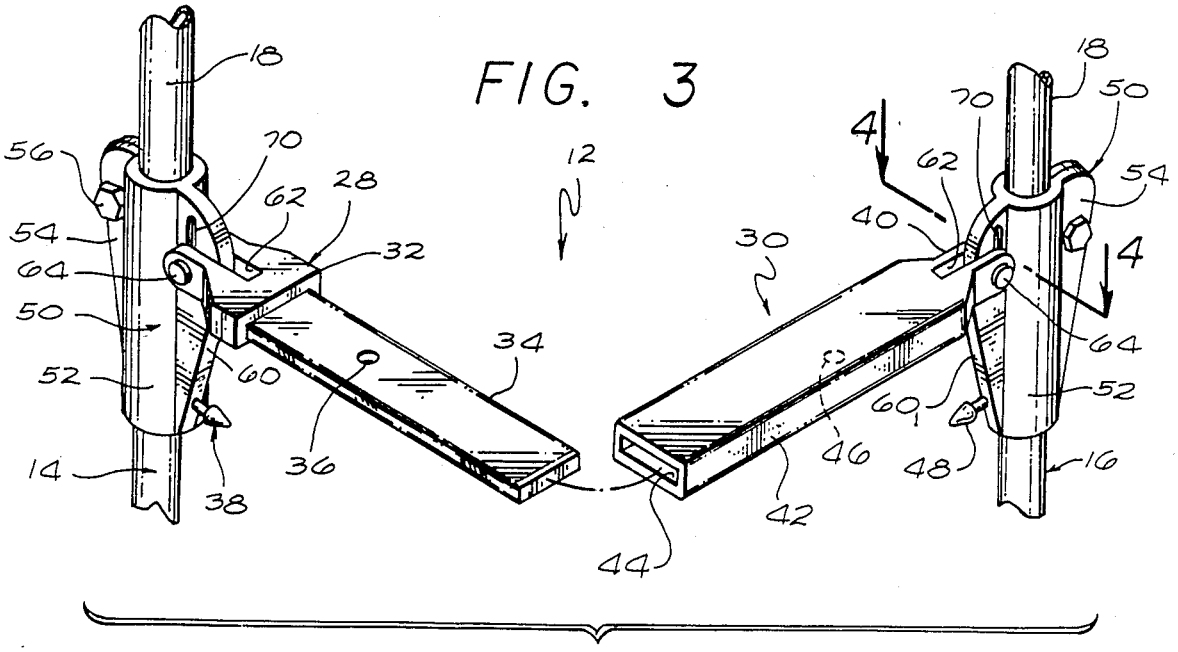
FIG. 3 is an enlarged, fragmented perspective view of the seat portion of the ski pole assembly of FIG. 1, illustrating the separable male and female seat components and their respective sleeve supports.

When the skier 26 desires to be seated on the mountain slope, while waiting in a lift line, or at any other time when it would be undesirable to loosen the skier's bindings 86 and remove his skis 88, the skiers' seat 12 can be quickly and easily assembled to form the ski pole assembly as illustrated in FIGS. 1 and 2. To accomplish this, each of the seat components 28 and 30 pivoted upwardly into their respective second positions. The interaction of the knobs 84 and the cavities 82 will tend to hold the seat components 28 and 30 in their second positions, as shown in FIG. 3. The ski poles 14 and 16 are then simply brought together to insert the support bar 34 within the receiving channel 44. When the seat components 28 and 30 are so mated, a rigid skiers' seat 12 is formed between the ski poles 14 and 16. The skier 26 may then comfortably sit upon the skier's seat 12 without removing his skis 88. The ski pole assembly 10 of the present invention can conveniently be moved with the skier as he progresses through a lift line, and then quickly disassembled before climbing before a ski lift.

Disassembly of the skiers' seat 12 simply requires withdrawal of the support bar 34 from the receiving channel 44. A slight tap on the upper surface of each seat component 28 and 30 will permit gravity and the spring 66 to pull the seat components into their respective first positions. The skier would then push the seat components 28 and 30 over the respective retainer studs 38 and 48 to lock them in place.

From the foregoing it is to be appreciated that the ski pole assembly 10 of the present invention provides a skiers' seat 12 which is lightweight, durable and capable of being conveniently carried on standard ski poles without any appreciable degradation in the ability of the skier to use the poles. The skiers' seat 12 can be quickly and easily configured to provide a strong and reliable seat for the skier, and is further capable of being instantly disassembled to facilitate use of the ski pole assembly 10 in lift lines or other similar situations. Further, the skiers' seat 12 is of economical construction, and may be used with standard ski poles without requiring modifications to such ski poles.

Although a particular embodiment of the invention has been described in detail for purposes of illustration, various modifications may be made without departing from the spirit and scope of the invention. Accordingly, the invention is not to be limited, except as by the appended claims.

I claim:

1. A skiers' seat for use with standard ski poles, the seat comprising;

a first rigid seat component;

means for attaching the first seat component to a first pole to permit pivotal movement of the first seat component between a first position which permits normal use of the first pole during skiing, and a second position;

a second rigid seat component;

means for attaching the second seat component to a second pole to permit pivotal movement of the second seat component between a first position which permits normal use of the second pole during skiing, and a second position; and means for connecting the first seat component and the second seat component with each in its respective second position, to form a rigid seat extending between the first and second poles.

2. A skiers' seat as set forth in claim 1 wherein the means for attaching the first seat component to the first pole includes a first sleeve positionable on the first pole, and first bracket means associated with the first seat component, wherein the first bracket means is pivotable with respect to the first sleeve.

3. A skiers' seat as set forth in claim 2, wherein the means for attaching the second seat component to the second pole includes a second sleeve positionable on the second pole, and second bracket means associated with the second seat component, wherein the second bracket means is pivotable with respect to the second sleeve.

4. A skiers' seat as set forth in claim 3, wherein the first seat component includes a support bar fixed to the first bracket means, and the second seat component includes a sheath fixed to the second bracket means, whereby the first seat component is connected to the second seat component to form the rigid seat extending between the first and second poles, by inserting the support bar into the sheath.

5. A skiers' seat as set forth in claim 1, including means for holding the first and second seat components in their respective second positions prior to connecting the first and second seat components to form the rigid seat extending between the first and second poles.

6. A skiers' seat as set forth in claim 1, including means for biasing the first and second seat components toward their respective first positions.

7. A skiers' seat as set forth in claim 1, including means for locking the first and second seat components in their respective first positions.

8. A skiers' seat as set forth in claim 5, wherein the holding means includes cavity means associated with the means for attaching the first seat component to the first pole and the means for attaching the second seat component to the second pole, and knob means associated with the first and second seat components, whereby the knob means engage the cavity means as the seat components are pivoted to their respective second positions.

9. A skiers' seat as set forth in claim 6, including means for locking the first and second seat components in their respective first positions, wherein the biasing means includes a spring operatively connected between both sets of seat components and associated attaching means, and wherein the locking means includes a seat retainer stud associated with each of the attaching means, and a stud locking aperture associated with each of the seat components, whereby the seat retainer studs engage the respective seat components as they are pivoted to their respective first positions.

10. A snow ski pole assembly capable of providing a seat for a skier, the assembly comprising:

a first pole having an elongated shaft;

a seat assembly fixed at one end to the first pole and pivotable between a first position wherein the seat assembly lies substantially parallel to the first pole shaft to permit normal use of the first pole while skiing, and a second position wherein the seat assembly extends substantially perpendicularly away from the first pole shaft, wherein the seat assembly includes a first sleeve positionable on the first pole, and seat means pivotable with respect to the first sleeve between the first position and the second position;

a second pole having an elongated shaft; and means for supporting the seat assembly in its second position, including a second sleeve positionable on the second pole, and means for engaging the seat means, the engaging means being pivotable between a first position which permits normal use of the second pole during skiing, and a second position extending substantially perpendicularly away from the second pole shaft.

11. An assembly as set forth in claim 10, including means for holding the seat means and the engaging means in their respective second positions.

12. An assembly as set forth in claim 11, wherein the holding means includes cavity means associated with the first sleeve, and knob means associated with the seat means, whereby the knob means engages the cavity means as the seat means is pivoted to its second position.

13. An assembly as set forth in claim 11, wherein the holding means includes cavity means associated with the second sleeve, and knob means associated with the engaging means, whereby the knob means engages the cavity means as the engaging means is pivoted to its second position.

14. An assembly as set forth in claim 10, wherein the seat means includes a sheath, and the means for engaging the seat means includes a support bar which is insertable into the sheath to form the rigid seat for a skier when the seat means and the engaging means are in their respective second positions.

15. An assembly as set forth in claim 10, including means for biasing the seat means and the engaging means toward their respective first positions, and means for locking the seat means and the engaging means in their respective first positions.

16. An assembly as set forth in claim 15, wherein the biasing means includes a spring operatively connected between the first sleeve and the seat means, on one hand, and the second sleeve and the engaging means, on the other, and wherein the locking means includes a seat retainer stud associated with each of the first and second sleeves, and a stud locking aperture associated with each of the seat means and the engaging means.

17. A skiers' seat apparatus configured to be carried on a pair of ski poles and movable between a first position which permits normal use of the ski poles while skiing, and a second position which, in connection with the poles, forms a stable seat for the skier, the seat apparatus comprising:

a first sleeve positionable on a first ski pole;

a male seat component including a first bracket attached to the first sleeve and pivotable with respect thereto, and a support bar rigidly extending outwardly from the first bracket, wherein the first bracket and the support bar are pivotable between the first position wherein the male seat component lies substantially parallel to the first pole to permit normal use of the first pole while skiing, and a second position wherein the male seat component extends substantially perpendicularly away from the first pole;

a second sleeve positionable on a second ski pole;

a female seat component including a second bracket attached to the second sleeve and pivotable with respect thereto, and receiving means rigidly extending outwardly from the second bracket, wherein the second bracket and the receiving means are pivotable between a first position wherein the female seat component lies substantially parallel to the second pole to permit normal use of the second pole while skiing, and a second position wherein the female seat component extends substantially perpendicularly away from the second pole, the receiving means capable of engaging the support bar when each is in its respective second position to form a rigid seat extending between the first and second poles;

means for holding the male seat component and the female seat component in their respective second positions prior to engagement of the receiving means and the support bar;

means for biasing the male seat component and the female seat component toward their respective first positions; and means for locking the male seat component and the female seat component in their respective first positions.

18. A seat apparatus as set forth in claim 17, wherein the receiving means includes a sheath in which the support bar is inserted to form the rigid seat extending between the first and second poles.

19. A seat apparatus as set forth in claim 17, wherein the holding means includes cavity means associated with the first and second sleeves, and knob means associated with the first and second brackets, whereby the knob means engage the cavity means as the brackets are pivoted to their respective second positions.

20. A seat apparatus as set forth in claim 17, wherein the biasing means includes a spring operatively connected between both sets of sleeves and brackets.

21. A seat apparatus as set forth in claim 17, wherein the locking means includes a seat retainer stud associated with each of the first and second sleeves, and a stud locking aperture associated with each of the seat components, whereby the seat retainer studs engage the respective seat components as they are pivoted to their respective first positions.

* * * * *

UNITED STATES PATENT AND TRADEMARK OFFICE

CERTIFICATE OF CORRECTION

PATENT NO. : 4,786,082

DATED : November 22, 1988

INVENTOR(S) : Daniel A. Swietlik

It is certified that error appears in the above-identified patent and that said Letters Patent is hereby corrected as shown below:

In Column 3, line 19, add the word "a" between the words "is" and "perspective."

In Column 3, line 33, add the word "in" between the words "shown" and "the."

In Column 4, line 27, delete the word "set" and insert therefor --seat--.

In Column 4, line 65, delete the word "holing" and insert therefor --holding--.

In Column 5, line 54, add the words "would be pulled away from the locking mechanisms 76 and" between the number "30" and the word "pivoted."

Signed and Sealed this

Twenty-third Day of May, 1989

*Attest:*

DONALD J. QUIGG

*Attesting Officer*

*Commissioner of Patents and Trademarks*